US010240401B2

(12) United States Patent
Partouche

(10) Patent No.: US 10,240,401 B2
(45) **Date of Patent: *Mar. 26, 2019**

(54) PIPE JOINT HAVING COUPLED ADAPTER

(71) Applicant: INTELLISERV, LLC, Houston, TX (US)

(72) Inventor: Ashers Partouche, Richmond, TX (US)

(73) Assignee: Intelliserv, LLC, Houston, TX (US)

( * ) Notice: Subject to any disclaimer, the term of this patent is extended or adjusted under 35 U.S.C. 154(b) by 289 days.

This patent is subject to a terminal disclaimer.

(21) Appl. No.: 15/160,931

(22) Filed: May 20, 2016

(65) Prior Publication Data

US 2016/0340982 A1 Nov. 24, 2016

Related U.S. Application Data

(63) Continuation of application No. 13/690,885, filed on Nov. 30, 2012, now Pat. No. 9,366,094.

(51) Int. Cl.

| | |
|---|---|
| ***E21B 17/02*** | (2006.01) |
| ***E21B 17/042*** | (2006.01) |
| ***E21B 17/046*** | (2006.01) |
| ***E21B 17/00*** | (2006.01) |

(52) U.S. Cl.
CPC ..... *E21B 17/028* (2013.01); *E21B 17/003* (2013.01); *E21B 17/042* (2013.01); *E21B 17/046* (2013.01); *E21B 17/023* (2013.01)

(58) Field of Classification Search
CPC ..... E21B 17/023; E21B 17/028
See application file for complete search history.

(56) References Cited

U.S. PATENT DOCUMENTS 4,605,268 A * 8/1986 Meador ..... E21B 17/028 340/855.2
9,366,094 B2 * 6/2016 Partouche ..... E21B 17/028

* cited by examiner

*Primary Examiner* — Giovanna C. Wright
(74) *Attorney, Agent, or Firm* — Conley Rose, P.C.

(57) ABSTRACT

An adapter for a wired drill pipe joint includes an annular adapter body having a first end, a second end, and an outer recess configured to receive a latch, an annular recess extending partially into the first end of the adapter body, a communication element disposed at least partially within the annular recess, wherein the second end of the adapter body is configured to be coupled to an end portion of a first wired drill pipe joint, and an annular latch coupled to the adapter body and configured to contact the first wired drill pipe joint when the adapter body is coupled to the first wired drill pipe joint and to resist decoupling of the adapter body from the first wired drill pipe joint.

20 Claims, 11 Drawing Sheets

PIPE JOINT HAVING COUPLED ADAPTER

CROSS-REFERENCE TO RELATED APPLICATIONS

This application is a continuation of U.S. application Ser. No. 13/690,885 filed Nov. 30, 2012, and entitled "Pipe Joint Having Coupled Adapter," which is incorporated herein by reference in its entirety for all purposes.

STATEMENT REGARDING FEDERALLY SPONSORED RESEARCH OR DEVELOPMENT

Not applicable.

BACKGROUND

Field of the Disclosure

This disclosure relates to connections between downhole tubulars, such as drill pipe tool joints or connections. More particularly, this disclosure relates to methods and apparatuses for strengthening the connections between wired drill pipe (WDP) joints.

Background of the Technology

In drilling by the rotary method, a drill bit is attached to the lower end of a drill stem composed of lengths of tubular drill pipe and other components that are joined together by connections with rotary shouldered threaded connections. In this disclosure, "drill stem" is intended to include other forms of downhole tubular strings such as drill strings and work strings. A rotary shouldered threaded connection may also be referred to as RSTC.

The drill stem may include threads that are engaged by right hand and/or left hand rotation. The threaded connections must sustain the weight of the drill stem, withstand the strain of repeated make-up and break-out, resist fatigue, resist additional make-up during drilling, provide a leak proof seal, and not loosen during normal operations.

The rotary drilling process subjects the drill stem to tremendous dynamic tensile stresses, dynamic bending stresses and dynamic rotational stresses that can result in premature drill stem failure due to fatigue. The accepted design of drill stem connections is to incorporate coarse tapered threads and metal to metal sealing shoulders. Proper design is a balance of strength between the internal and external thread connection. Some of the variables include outside diameter, inside diameters, thread pitch, thread form, sealing shoulder area, metal selection, grease friction factor and assembly torque. Those skilled in the art are aware of the interrelationships of these variables and the severity of the stresses placed on a drill stem.

The tool joints or pipe connections in the drill stem must have appropriate shoulder area, thread pitch, shear area and friction to transmit the required drilling torque. In use, all threads in the drill string must be assembled with a torque that exceeds the required drilling torque in order to handle tensile and bending loads without shoulder separation. Shoulder separation causes leaks and fretting wear. Relatively deeper wells require a greater amount of drilling torque to be applied to the drill string during drilling. In order to avoid uncontrolled downhole makeup of the drill string, the torque applied during makeup must be increased, thereby increasing the amount of stress on the RSTC connection. In response to this issue, double shouldered connections have been developed to better distribute stress generated from the makeup torque and apply it to the connection across a primary and a secondary shoulder of the RSTC. However, in the case of WDP, in order to transmit a signal along the length of the drill string, a groove is provided within the body of each tubular member of the drill string. This groove may extend through one of the shoulders of a double shouldered connection, forming a stress riser within the connection by reducing the surface area of the affected shoulder in the connection.

Accordingly, there remains a need in the art for an apparatus and methods for strengthening the connections between segments of drill pipe, particularly WDP. Such apparatuses and methods would be particularly well received if they could provide stronger connections in an efficient and relatively cost effective manner.

BRIEF SUMMARY OF THE DISCLOSURE

An embodiment of an adapter for a wired drill pipe joint, comprises an annular adapter body having a first end, a second end, and an outer recess configured to receive a latch, an annular recess extending partially into the first end of the adapter body, a communication element disposed at least partially within the annular recess, wherein the second end of the adapter body is configured to be coupled to an end portion of a first wired drill pipe joint, and an annular latch coupled to the adapter body and configured to contact the first wired drill pipe joint when the adapter body is coupled to the first wired drill pipe joint and to resist decoupling of the adapter body from the first wired drill pipe joint, wherein the annular adapter body and the communication element form a shoulder configured for engagement with a corresponding shoulder of a second wired drill pipe joint to form a rotary shouldered threaded connection between the first wired drill pipe joint and the second wired drill pipe joint. In some embodiments, the latch comprises a canted coil spring. In some embodiments, the latch is biased to expand radially outward with respect to a central axis of the latch. In certain embodiments, the second end of the adapter body is configured to be releasably coupled to an end portion of the first wired drill pipe joint. In certain embodiments, the adapter body further comprises an arcuate key that is configured to restrict relative rotation of the adapter body with respect to the first wired drill pipe joint. In some embodiments, the first wired drill pipe joint further comprises a slot, and wherein the arcuate key of the adapter body is configured to be inserted at least partially into the slot. In some embodiments, the latch is disposed radially between the annular adapter body and the first wired drill pipe joint when the adapter body is coupled to the first wired drill pipe joint. In certain embodiments, when the adapter body is coupled to the first wired drill pipe joint, the annular latch is biased radially outwards into an inner recess of the first wired drill pipe joint to secure the adapter body to the first wired drill pipe joint.

An embodiment of a method for forming a wired drill pipe joint comprises coupling an annular adapter body to an end portion of a first wired drill pipe joint, disposing a communication element within an annular recess of the adapter body, and disposing a latch in a recess positioned between the adapter body and the first wired drill pipe joint, wherein coupling the adapter body to an end portion of the first wired drill pipe joint forms an annular shoulder on an end portion of the first wired drill pipe joint that is configured to engage a corresponding annular shoulder of a second wired drill pipe joint for forming a rotary shouldered threaded connection between the first wired drill pipe joint and the second wired drill pipe joint. In some embodiments, coupling the adapter body to an end portion of the first wired drill pipe joint comprises releasably coupling the adapter body to an end portion of the first wired drill pipe joint. In some embodiments, the method further comprises inserting an arcuate key of the adapter body into a slot of the first wired drill pipe joint. In certain embodiments, the method further comprises decoupling the adapter body from the end portion of the first wired drill pipe joint. In certain embodiments, the method further comprises forming a joint between the first wired drill pipe joint and a second wired drill pipe joint, and providing a compressive stress against a side of the adapter body. In some embodiments, the method further comprises communicating a signal between the first wired drill pipe joint and the second wired drill pipe joint. In some embodiments, the method further comprises biasing the latch radially outwards into a recess of the first wired drill pipe joint to secure the adapter body to the first wired drill pipe joint.

An embodiment of a wired drill pipe joint comprises an annular adapter body having a first end and a second end, an annular recess extending partially into the first end of the adapter body, a communication element disposed at least partially within the annular recess, wherein the second end of the adapter body is configured to be releasably coupled to an end portion of a first wired drill pipe joint, a pin coupled to the communication element, and a connector disposed within a recess of the first wired drill pipe joint and configured to releasably engage the pin, wherein the annular adapter body and the communication element form a shoulder of the first wired drill pipe joint configured for engagement with a corresponding shoulder of a second wired drill pipe joint to form a rotary shouldered threaded connection between the first wired drill pipe joint and the second wired drill pipe joint. In some embodiments, the annular adapter body comprises an arcuate key configured to restrict relative rotation of the adapter body with respect to the first wired drill pipe joint. In some embodiments, the first wired drill pipe joint further comprises an arcuate slot, and wherein the arcuate key is disposed at least partially in the arcuate slot. In certain embodiments, the pin comprises an electrical conductor configured to communicate an electrical signal to the connector. In certain embodiments, the pin comprises protrusions extending radially from the pin, and the connector comprises a socket configured to receive the protrusions of the pin to couple the adapter body to the first wired drill pipe joint.

BRIEF DESCRIPTION OF THE DRAWINGS

For a detailed description of the exemplary embodiments of the invention that are disclosed herein, reference will now be made to the accompanying drawings in which.

DETAILED DESCRIPTION

Figure 1:
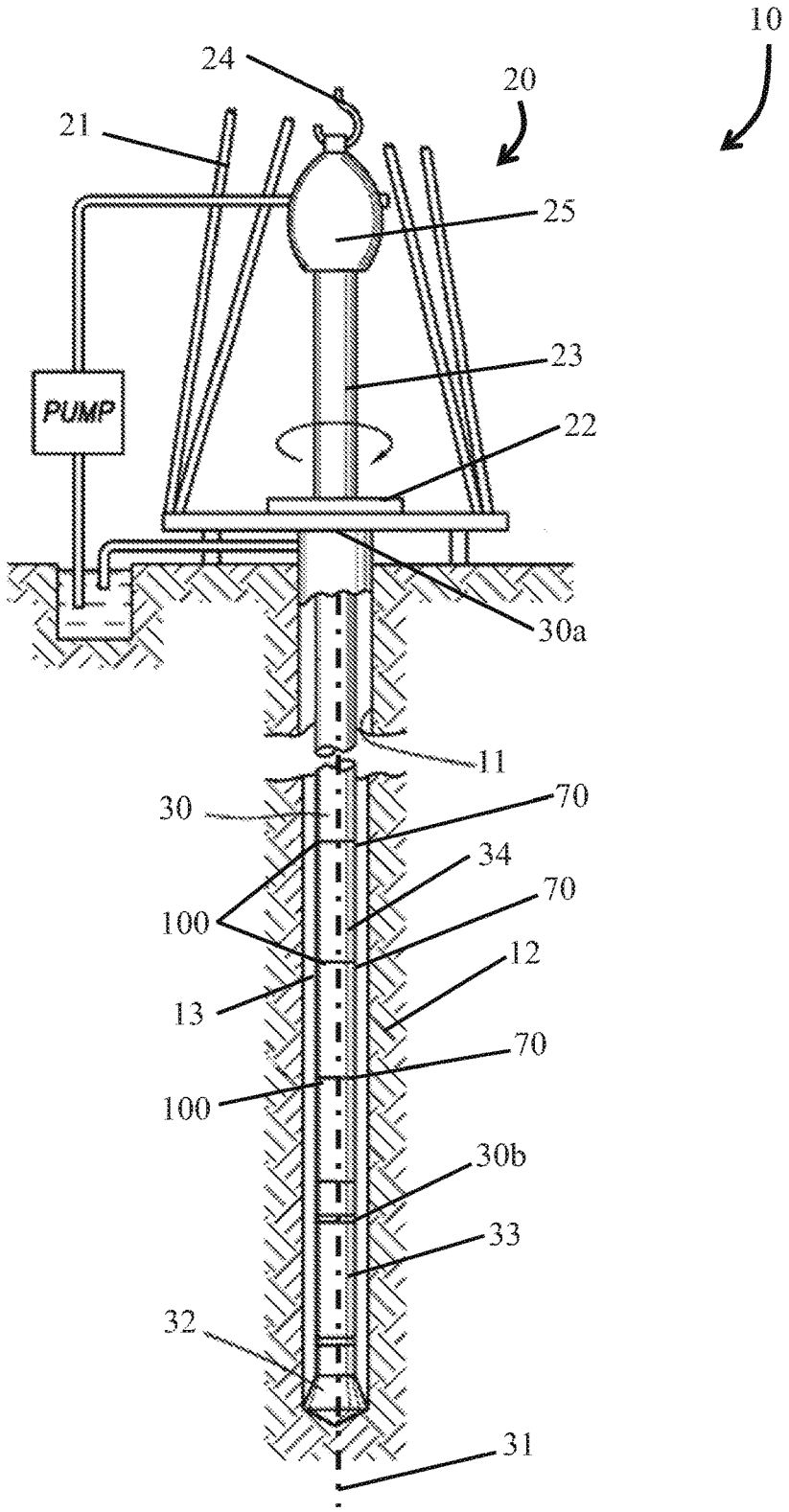
FIG. 1 is a schematic view of an embodiment of a drilling system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. Further, "couple" or "couples" may refer to coupling via welding or via other means, such as releasable connections using a connector, pin, key or latch. In addition, as used herein, the terms "axial" and "axially" generally mean along or parallel to a given axis (e.g., given axis of a body or a port), while the terms "radial" and "radially" generally mean perpendicular to the given axis. For instance, an axial distance refers to a distance measured along or parallel to the given axis, and a radial distance means a distance measured perpendicular to the given axis. Still further, as used herein, the phrase "communication coupler" refers to a device or structure that communicates a signal across the respective ends of two adjacent tubular members, such as the threaded box/pin ends of adjacent pipe joints; and the phrase "wired drill pipe" or "WDP" refers to one or more tubular members, including drill pipe, drill collars, casing, tubing, subs, and other conduits, that are configured for use in a drill string and include a wired link. As used herein, the phrase "wired link" refers to a pathway that is at least partially wired along or through a WDP joint for conducting signals, and "communication link" refers to a plurality of communicatively-connected tubular members, such as interconnected WDP joints for conducting signals over a distance.

Referring now to FIG. 1, an embodiment of a drilling system 10 is schematically shown. In this embodiment, drilling system 10 includes a drilling rig 20 positioned over a borehole 11 penetrating a subsurface formation 12 and a drill string 30 suspended in borehole 11 from a derrick 21 of rig 20. Elongate drill string 30 has a central or longitudinal axis 31, a first or upper end 30*a*, and a second or lower end 30*b* opposite end 30*a*. In addition, drill string 30 includes a drill bit 32 at lower end 30*b*, a bottomhole assembly (BHA) 33 axially adjacent bit 32, and a plurality of interconnected wired drill pipe (WDP) joints 34 between BHA 33 and upper end 30*a*. BHA 33 and WDP joints 34 are coupled together end-to-end at tool joints or connections 70. As will be discussed further herein, in this embodiment, connections 70 comprise double shouldered RSTCs.

In general, BHA 33 can include drill collars, drilling stabilizers, a mud motor, directional drilling equipment, a power generation turbine, as well as capabilities for measuring, processing, and storing information, and communicating with the surface (e.g., MWD/LWD tools, telemetry hardware, etc.). Examples of communication systems that may be included in BHA 33 are described in U.S. Pat. No. 5,339,037, incorporated herein in its entirety by this reference.

In this embodiment, drill bit 32 is rotated by rotation of drill string 30 at the surface. In particular, drill string 30 is rotated by a rotary table 22, which engages a kelly 23 coupled to upper end 30*a*. Kelly 23, and hence drill string 30, is suspended from a hook 24 attached to a traveling block (not shown) with a rotary swivel 25 which permits rotation of drill string 30 relative to hook 24. Although drill bit 32 is rotated from the surface with drill string 30 in this embodiment, in general, the drill bit (e.g., drill bit 32) can be rotated via a rotary table and/or a top drive, rotated by downhole mud motor disposed in the BHA (e.g., BHA 33), or by combinations thereof (e.g., rotated by both rotary table via the drill string and the mud motor, rotated by a top drive and the mud motor, etc.). Thus, it should be appreciated that the various aspects disclosed herein are adapted for employment in each of these drilling configurations and are not limited to conventional rotary drilling operations.

In this embodiment, a transmitter in BHA 33 transmits communication signals through WDP joints 34 and drill string 30 to a data analysis and communication system at the surface. As will be described in more detail below, each tubular in drill string 30 (e.g., WDP joints 34, etc.) includes a wired communication link that allows transmission of electronic communication signals along the tubular, and each connection 70 includes an inductive communication coupler that allows transmission of communication signals across the connection 70, thereby enabling transmission of communication signals (e.g., electronic telemetry signals) between BHA 33 or other components in drill string 30 and the communication system at the surface. Further, an adapter 100 is disposed at each connection 70 where it is coupled to an end of each WDP joint 34.

Figure 2:
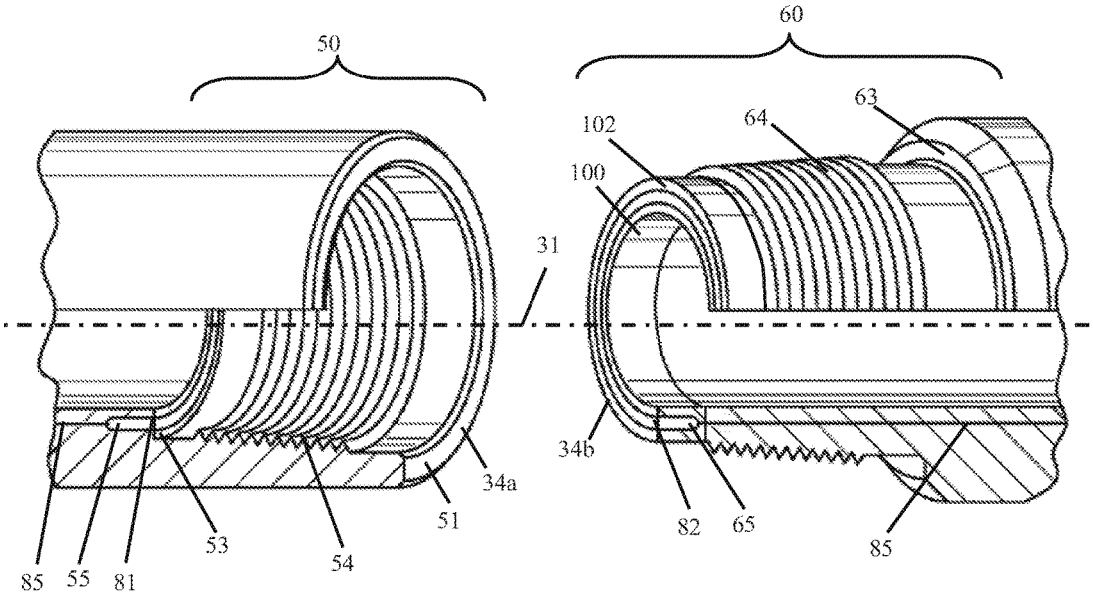
FIG. 2 is a perspective partial cross-sectional view of a pin end portion and a mating box end portion of a pair of tubulars used to form a drill string as may be employed in the drilling system of FIG. 1.
Figure 3:
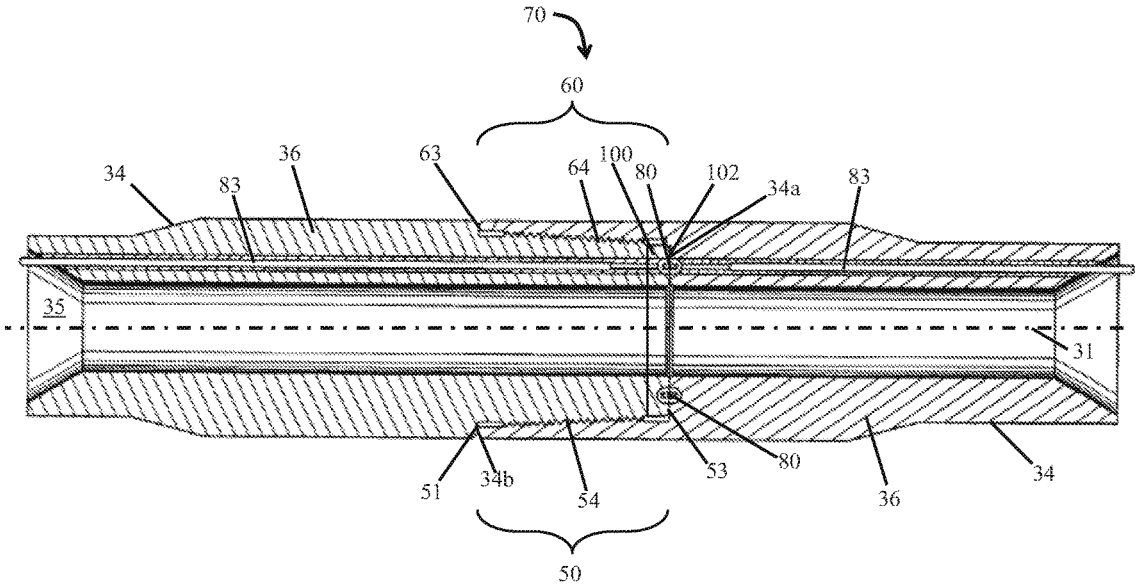
FIG. 3 is a cross-sectional view of a connection formed with the pin end portion and the box end portion of FIG. 2.

Referring now to FIGS. 2 and 3, the tubulars forming drill string 30 (e.g., WDP joints 34, etc.) include an axial bore 35 that allows the flow of drilling fluid through string 30, a tubular member or body 36 having a box end portion 50 at one end (e.g., the lower end), and a pin end portion 60 at the opposite end (e.g., the upper end). Box end portion 50 and pin end portion 60 physically interconnect adjacent tubulars end-to-end, thereby defining connections 70.

FIGS. 2 and 3 illustrate one box end portion 50 and one mating pin end portion 60 for forming one connection 70, it being understood that all the pin end portions, box end portions, and tool joints in drill string 30 are configured similarly in this example. Box end portion 50 comprises an axial portion of WDP joint 34 extending between a secondary or radially inner shoulder 53 to a primary or radially outer shoulder 51 disposed at a terminal end 34*a* of WDP joint 34. Box end portion 50 generally includes primary shoulder 51, secondary shoulder 53 axially spaced apart from shoulder 51, and internal threads 54 axially positioned between shoulders 51, 53. Pin end portion 60 comprises an axial portion of WDP joint 34, extending between a primary or radially outer shoulder 63 and a secondary or radially inner shoulder 102 disposed at a terminal end 34*b* of WDP joint 34. Pin end portion 60 generally includes an annular adapter 100 that forms secondary shoulder 102, primary shoulder 63 that is axially spaced from shoulder 102, and external threads 64 that are axially positioned between shoulders 102, 63. Since box end portion 50 and pin end portion 60 each include two planar shoulders 51, 53 and 102, 63, respectively, ends 50 and 60 form a double shouldered RSTC upon being threaded together via mating threads 54, 64 to form connection 70. When threading box end portion 50 into a pin end portion 60, outer shoulders 51, 63 may axially abut and engage one another, and inner shoulders 53, 102 may axially abut and engage one another to provide structural support and to distribute stress across the connection. As shown in FIG. 3, upon forming connection 70, box end portion 50 and pin end portion 60 axially overlap. as primary shoulders 51, 63 abut and secondary shoulders 53, 102 abut.

Referring still to FIG. 3, an inductive communication coupler 80 is used to communicate data signals across each connection 70 (i.e., communicated between mating box end portion 50 and pin end portion 60) in drill string 30. Although only one communication coupler 80 is shown in FIG. 3, each communication coupler 80 in drill string 30 is configured similarly. Referring to FIGS. 2 and 3, communication coupler 80 is formed by physically engaging a first annular inductive coupler element 81 and a second annular inductive coupler element 82 axially opposed first inductive coupler element 81. In this embodiment, first inductive coupler element 81 is seated in an annular recess 55 formed in inner shoulder 53 of box end portion 50, and second inductive coupler element 82 is seated in an annular recess 65 formed in inner shoulder 102 of pin end portion 60 that comprises annular adaptor 100. Recesses 55, 65, formed in shoulders 53, 102, respectively, decrease the surface area of each shoulder 53, 102. Thus, given a compressive force applied axially against shoulders 53, 102, the amount of stress imparted to each shoulder 53, 102 by the given compressive force is increased due to the smaller surface area afforded by the presence of recesses 55, 65. In this embodiment, coupling elements 81, 82 are disposed in opposed recesses 55, 65, of inner shoulders 53, 102, respectively. However, in other embodiments, the inductive coupling elements (e.g., elements 81, 82) may be seated in opposed recesses formed in the outer shoulders (e.g., shoulders 51, 63), or a first pair of inductive coupling elements may be seated in opposed recesses formed in the outer shoulders and a second pair of inductive coupling elements can be seated in opposed recesses formed in the inner shoulders.

Referring still to FIGS. 2 and 3, coupler elements 81, 82, disposed in the box end portion 50 and pin end portion 60, respectively, of each tubular are interconnected by a cable 83 routed within the tubular body from the box end portion 50 to the pin end portion 60. Cable 83 transmits signals between coupler elements 81, 82 of the tubular. Communication signals (e.g., telemetry communication signals) can be transmitted through cables 83 and couplers 80 from BHA 33 or other component in drill string 30 to the communication system at the surface, or from the surface communication system to BHA 33 or other component in drill string 30.

Figure 4:
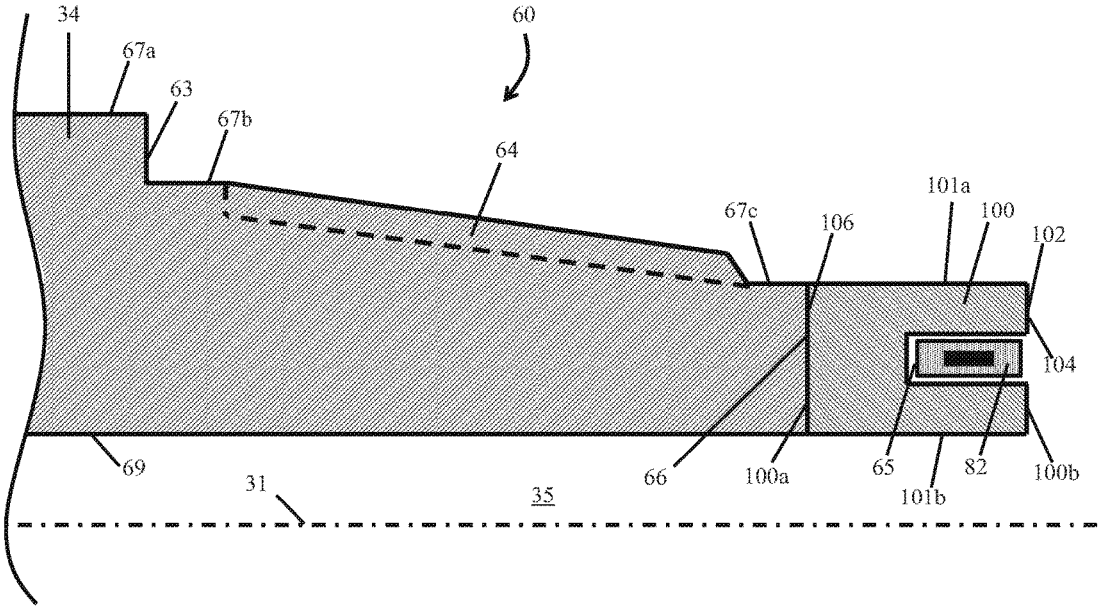
FIG. 4 is a cross-sectional view of an embodiment of a strengthened shoulder of a RSTC as may be employed in the drilling system of FIG. 1.

Referring now to FIG. 4, an embodiment of a strengthened shoulder of a RSTC is shown. In this embodiment, annular adapter 100 is configured to couple to a terminal end of a tubular member, such as WDP joint 34. Pin end portion 60 of WDP joint 34 comprises a first outer cylindrical surface 67*a*, a second outer cylindrical surface 67*b*, a third cylindrical outer surface 67*c*, an inner cylindrical surface 69, an outer or primary annular shoulder 63 extending radially inward from surface 67*a* to surface 67*b*, a frustoconical threaded segment or portion 64 and a terminal end 66 that extends radially inward from surface 67*c* to inner surface 69. Threaded portion 64 is configured to allow pin end portion 60 to couple with an associated box end portion of another WDP joint in the drill string. In this embodiment, annular inner or secondary shoulder 102 is formed on the pin end portion 60 of WDP joint 34 by coupling adapter 100 to terminal end 66 of pin end portion 60. Annular adapter 100 has a central axis coaxial with axis 31, a first end 100*a* and a second end 100*b*. Annular secondary shoulder 102 of adapter 100 extends radially inward from an outer cylindrical surface 101*a* to an inner cylindrical surface 101*b* of adapter 100, and includes an annular groove or recess 65 that extends axially into adapter 100 from shoulder 102. In this embodiment, outer surface 101*a* has a radius substantially equal to surface 67*c* and inner surface 101*b* has a radius substantially equal to inner surface 69. In the embodiment of FIG. 4, coupler element 82 may be disposed within recess 65 of adapter 100 to allow for the passing of electronic signals across the WDP joint 34 upon being made up with the box end portion of another WDP joint.

Referring still to FIG. 4, annular secondary shoulder 102 defines an annular face 104 having a surface area. During makeup procedures, as pin end portion 60 and box end portion of two adjacent WDP joints 34 are made up to form a connection 70, a compressive force is applied to the face 104 of adapter 100 by a corresponding shoulder (e.g., shoulder 53 shown in FIG. 2) on the box end portion of the other WDP joint. As discussed earlier, the surface area of face 104 that may contact an opposing annular shoulder of a box end portion is reduced by the presence of recess 65, increasing the stress applied to the adapter 100 by a given compressive force generated during makeup. Thus, in order to maintain the same makeup torque used on tubular members that do not feature a recess 65 extending through an annular secondary shoulder, the strength of the material of the adapter 100 may be increased to allow the annular shoulder 102 to withstand a greater amount of applied compressive stress. In the embodiment of FIG. 4, adapter 100 comprises a material having high strength (e.g., compressive strength) and weldability characteristics with materials such as carbon steels, steel alloys, or other materials that may form drill pipe or other tubulars. For instance, adapter 100 comprises a material configured to have high strength, corrosion resistance and electrical conductivity. In this embodiment, the hardness of the material comprising adapter 100 has a harder Rockwell hardness than the material comprising WDP joint 34. In an embodiment, the adapter 100 may comprise a steel alloy having a high nickel, chrome, cobalt, and/or copper content, such as Monel, Hastelloy, Inconel, Waspaloy, Rene alloys, and the like. In this configuration, while adapter 100 comprises a material having a high compressive strength, the material forming the rest of the WDP joint 34 may be carbon steel or other materials traditionally used to form drill pipe or other tubulars, allowing the WDP joint 34 to maintain its ductility and fatigue strength. An alloy containing a high nickel content may be chosen to augment the strength of the adapter 100. In an embodiment, adapter 100 may also comprise a material suitable for high strength and/or to reduce or eliminate corrosion. An alloy containing a high copper content may be chosen to augment the electrical conductivity of adapter 100. In another embodiment, adapter 100 may comprise a high nickel content steel alloy coated in a higher copper content material in order to provide for both high strength and electrical conductivity of adapter 100.

Referring still to FIG. 4, first end 100*a* of adapter 100 is configured to couple to WDP joint 34 at terminal end 66 of the joint 34. The adapter 100 may be coupled at first end 100*a* to end 66 of WDP joint 34 using a means configured to allow the adapter 100 to resist torsional, compressive and other loads applied to adapter 100. For instance, adapter 100 may be welded at first end 100*a* to end 66 of WDP joint 34 using an electron beam welding procedure where the kinetic energy of a beam of electrons is used to fuse the adapter 100 and WDP joint 34 together at ends 100*a* and 66. In another embodiment, adapter 100 may be friction welded to WDP joint 34 at ends 100*a* and 66, respectively. For instance, in this procedure annular adapter 100 may be rotated about axis 31 as first end 100*a* of adapter 100 abuts and physically engages end 66 of WDP joint 34, causing adapter 100 and WDP joint 34 to fuse together at ends 100*a*, 66 due to the friction generated by the sliding engagement between adapter 100 and WDP joint 34.

Figure 5:
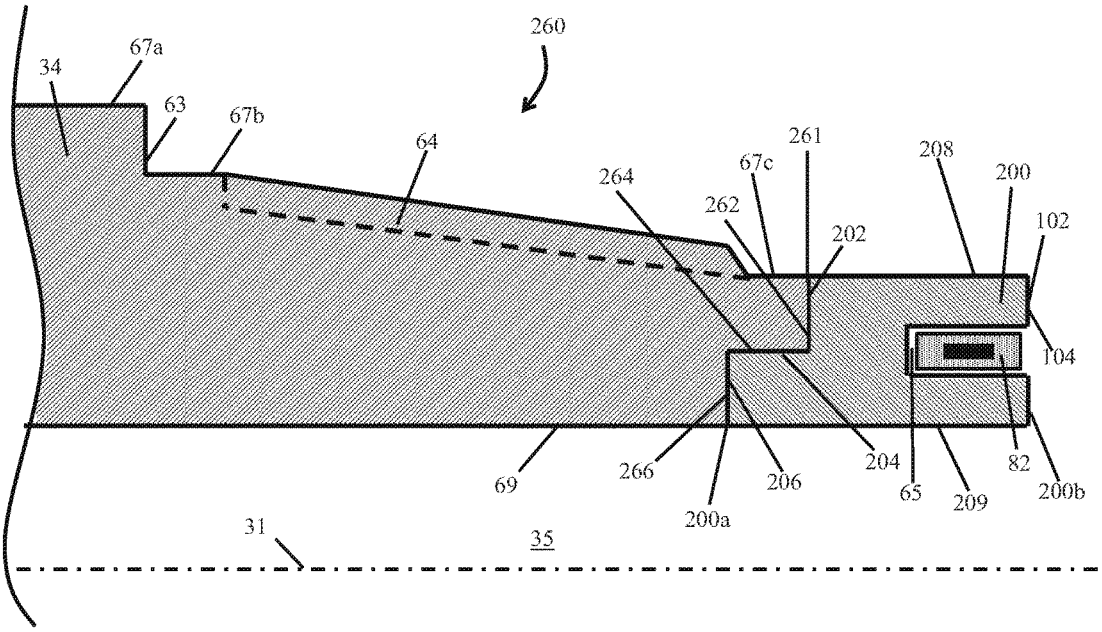
FIG. 5 is a cross-sectional view of another embodiment of a strengthened shoulder of a RSTC as may be employed in the drilling system of FIG. 1.

Referring to FIG. 5, another embodiment of a strengthened shoulder of a RSTC is shown to include an adapter 200 configured to be coupled to a terminal end of a tubular member, such as WDP joint 34. A pin end portion 260 of WDP joint 34 comprises outer surfaces 67*a*, 67*b*, 67*c*, inner surface 69, threaded portion 64 and a mating cylindrical surface 264. In this embodiment, the radius of surface 264 is larger than the radius of inner surface 69 but smaller than the radius of outer surface 67*c*. An upper mating shoulder 262 is formed at a terminal end 261 of WDP joint 34 and radially extends inward from cylindrical surface 67*c* to surface 264. Cylindrical surface 264 extends axially into WDP joint 34 from terminal end 261. A lower mating shoulder 266 radially extends inward from cylindrical surfaces 264 to inner cylindrical surface 69.

Secondary shoulder 102 may be formed on pin end portion 260 of WDP joint 34 by coupling adapter 200 to WDP joint 34. In this embodiment, adapter 200 is configured to physically engage mating shoulders 262, 266 and cylindrical surface 264 of WDP joint 34. Adapter 200 has a central axis coaxial with axis 31 and comprises a first end 200*a*, a second end 200*b*, an outer cylindrical surface 208, an inner cylindrical surface 209 and a mating cylindrical surface 204. In this embodiment, the radius of surface 204 is larger than the radius of inner surface 209 but smaller than the radius of surface 208. A lower annular shoulder 206 is disposed at end 200*a* and extends radially outward from inner surface 209 to surface 204. Surface 204 extends axially from first end 200*a* toward second end 200*b*. An upper annular shoulder 202 extends radially outward from surface 264 to outer surface 208. As shown, shoulders 206, 202 of adapter 200 are configured to physically engage corresponding shoulders 266, 262 of WDP joint 34. Also, cylindrical surface 204 of adapter 200 is configured to engage corresponding surface 264 of WDP joint 34.

Adapter 200 may comprise the same materials as discussed with respect to annular adapter 100 (e.g., high nickel content and/or high copper content alloy steel) to provide for greater strength compared to the materials comprising WPD joint 34. Adapter 200 comprises a material having a harder Rockwell hardness rating than the material comprising WDP joint 34. In an embodiment, adapter 200 and WDP joint 34 may be coupled at their respective mating surface using a tungsten inert gas (TIG) welding procedure using a filler rod comprising a material configured to allow the high nickel and/or high copper content of the adapter 200 to couple with the WDP joint 34, which may comprise carbon steel or other materials. In an embodiment, radial surface 204 of adapter 200 may be press fit against WDP joint 34 at radial surface 264 prior to welding adapter 200 to the WDP joint 34. In this embodiment, press fitting adapter 200 against WDP joint 34 may ensure proper alignment between the two members prior to welding.

Figure 6A:
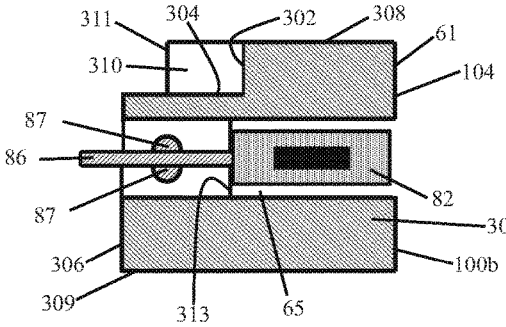
FIGS. 6A and 6B are cross-sectional views of an embodiment of a releasable shoulder of a RSTC as may be employed in the drilling system of FIG. 1.
Figure 6B:
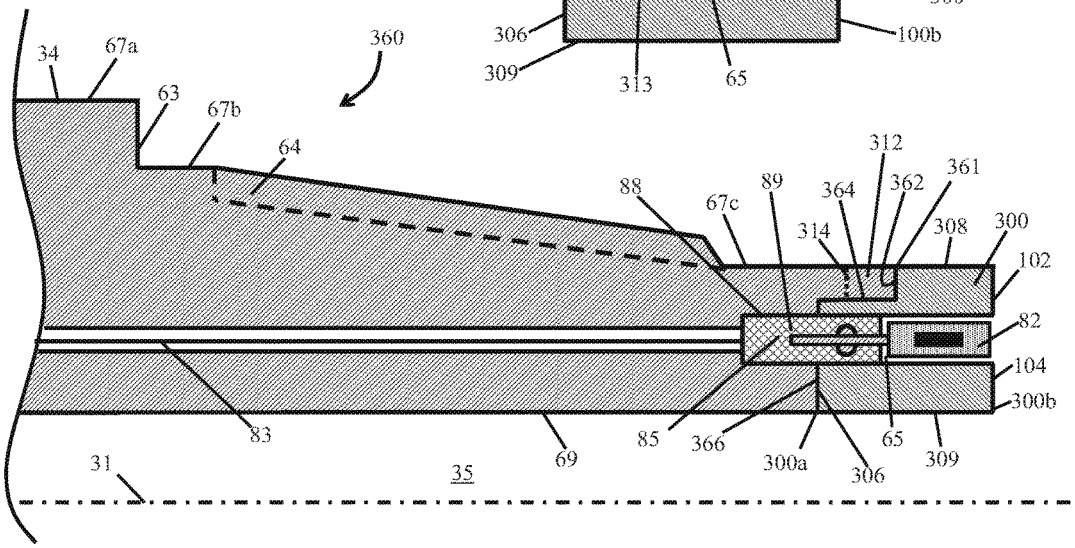

Referring to FIGS. 6A and 6B, another embodiment of a strengthened shoulder of a RSTC is shown. For clarity, an enlarged version of adapter 300 is shown by FIG. 6A. In this embodiment, an adapter 300 is configured to be coupled to a terminal end of a tubular member, such as WDP joint 34. Adapter 300 is configured to be releasably electrically coupled to WDP joint 34 via a connector 85. Adapter 300 may comprise the same materials as discussed with respect to annular adapters 100 and 200 (e.g., high nickel content and/or high copper content alloy steel) to provide for greater strength compared to the materials comprising WPD joint 34. In the embodiment of FIGS. 6A and 6B, adapter 300 may comprise materials having a harder Rockwell hardness rating than the materials comprising WDP joint 34.

As shown in FIG. 6B, cable 83 extends axially through WDP joint 34 to connector 85 that is disposed in a cavity 88 of the WDP joint 34. Connector 85 comprises a boot or socket 89 that is configured to allow for the conduction of electricity through the connector 85. Coupled to coupler element 82 is an elongate or generally cylindrical pin 86 (FIG. 6A) having one or more protrusions 87 that extend radially from pin 86. Pin 86 is an electrical conductor and may be inserted partially into connector 85 such that an electric signal may flow from cable 83, through connector 85 and pin 86 and into coupler element 82, or vice-a-versa (e.g., from coupler element 82 to cable 83). Pin 86 is an electrical conductor and may be inserted partially into connector 85 such that an electric signal may flow from cable 83, through connector 85 and pin 86 and into coupler element 82, or vice-a-versa (e.g., from coupler element 82 to cable 83). Protrusions 87 are configured to radially extend into socket 89 as pin 86 is inserted into connector 85. The physical engagement between protrusions 87 and socket 89 provide an axial resistance to the attached coupler element 82 and adapter 300 from becoming uncoupled from WDP joint 34. For instance, connector 85 may provide an axial force on protrusions 87 in the direction of WDP joint 34 in response to an opposed axial force on adapter 300 or coupler element 82 in the axial direction away from WDP joint 34. However, because socket 89 is formed from an elastomeric or deformable material, a large enough axial force applied to 300 will cause protrusions 87 to temporarily deform the material of socket 89, allowing adapter 300 to be uncoupled from pin end portion 360 of WDP joint 34. An annular partition 313 may extend through recess 65 to retain coupler element 82 within recess 65. One or more openings may be formed within annular partition 313 to allow pin 86 to extend axially therethrough.

In this embodiment, a pin end portion 360 of WDP joint 34 comprises outer surfaces 67*a*, 67*b*, 67*c*, inner surface 69, threaded portion 64 and a mating cylindrical surface 464. The radius of surface 364 is larger than the radius of inner surface 69 but smaller than the radius of outer surface 67*c*. An upper mating shoulder 362 is formed at a terminal end 361 of WDP joint 34 and radially extends inward from cylindrical surface 67*c* to surface 364. Cylindrical surface 364 extends axially into WDP joint 34 from terminal end 361. A lower mating shoulder 366 radially extends inward from cylindrical surfaces 364 to inner cylindrical surface 69.

Secondary annular shoulder 102 may be formed on pin end portion 360 of WDP joint 34 by coupling adapter 300 to WDP joint 34. In this embodiment, adapter 300 is configured to physically engage mating shoulders 362, 366 and cylindrical surface 364 of WDP joint 34. Adapter 300 has a central axis that is coaxial with axis 31 and comprises a first end 300*a*, a second end 300*b*, an outer cylindrical surface 308, an inner cylindrical surface 309 and a mating cylindrical surface 304 (FIG. 6A). In this embodiment, the radius of surface 304 is larger than the radius of inner surface 309 but smaller than the radius of surface 308. A lower annular shoulder 306 is disposed at end 300*a* and extends radially outward from inner surface 309 to surface 304. Surface 304 extends axially from first end 300*a* toward second end 300*b*. An upper annular shoulder 302 (FIG. 6A) extends radially outward from surface 364 to outer surface 308. In this embodiment, shoulders 306, 302 of adapter 300 are configured to physically engage corresponding shoulders 366, 362 of WDP joint 34. Also, cylindrical surface 304 of adapter 300 is configured to engage corresponding surface 364 of WDP joint 34.

Figure 6C:
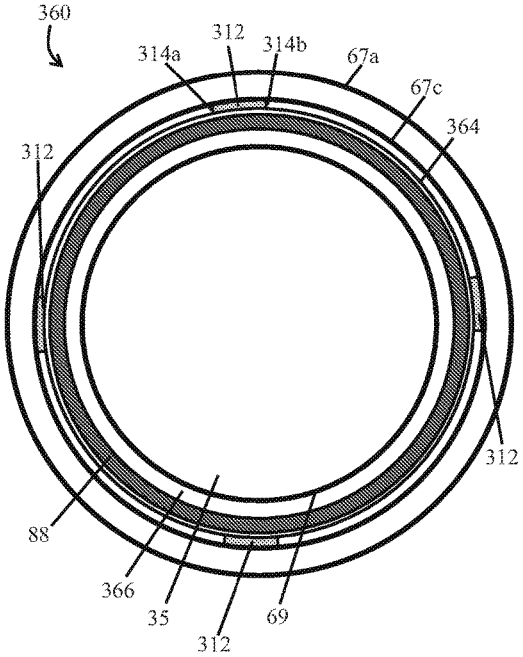
FIG. 6C is a front view of an embodiment of a pin end of a wired drill pipe joint as may be employed in the drilling system of FIG. 1.
Figure 6D:
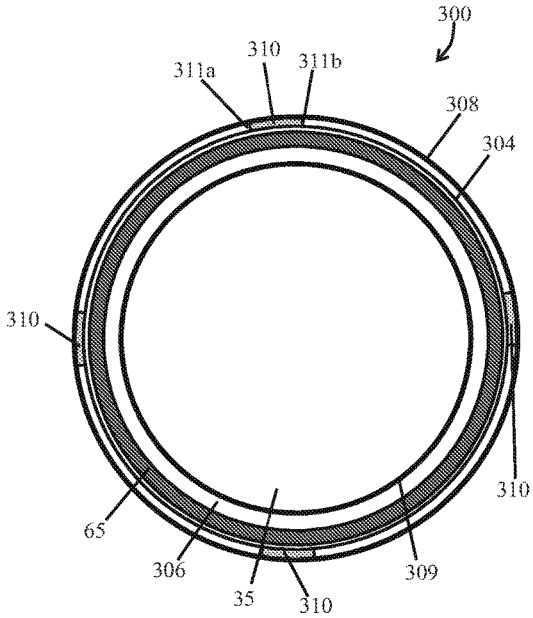
FIG. 6D is a front view of an embodiment of a releasable shoulder of a RSTC as may be employed in the drilling system of FIG. 1.

Referring to FIGS. 6A-6D, adapter 300 also comprises one or more arcuate anti-rotation keys 310 (FIGS. 6A, 6C) that are configured to physically engage one or more recesses in WDP joint 34 in order to restrict relative rotation of adapter 300 with respect to WDP joint 34. As shown in FIG. 6C, keys 310 are arcuate shaped members having a radius and a circumferential length that extends only over a portion of the circumference of shoulder 302. Thus, a plurality of keys 310 may be disposed at different circumferential positions along shoulder 302. Keys 310 are defined by outer cylindrical surface 308, mating cylindrical surface 304, and two radial edges, 311*a* and 311*b*, that radially extend between cylindrical surfaces 308 and 304. Although in this embodiment four arcuate keys 310 are shown, in other embodiments a different number of keys 310 may be used.

Keys 310 are configured to be inserted into one or more corresponding arcuate slots 312 that are disposed on upper mating surface 362 of pin end portion 360. Each arcuate shaped slot 312 is defined by outer surface 67*c*, cylindrical surface 364 and edges 314*a*, 314*b*, that radially extend between cylindrical surfaces 67*c*, 364. Each slot 312 extends axially into WDP joint 34 from upper mating shoulder 362, defining an inner vertical surface 314. Arcuate slots 312 each extend over a portion of the circumference of mating shoulder 362, and thus a plurality of slots 312 may be disposed at different circumferential positions along the circumference of shoulder 362. As each arcuate key 310 is inserted into a corresponding arcuate slot 312, edges 311*a*, 311*b*, of each key 310 slidably engages edges 314*a*, 314*b*, of each arcuate slot 312. In this embodiment, keys 310 are configured to prevent the relative rotation of adapter 300 with respect to WDP joint 34 as pin end portion 60 of WDP joint 34 is threadedly coupled with a box end portion of an adjacent WDP joint. Thus, by restricting the relative rotation of adapter 300 with respect to WDP joint 34, the electrical connection between cable 83 and coupler element 82 may be protected from severing due to relative rotation by adapter 300. In this embodiment, adapter 300 is secured to WDP joint 34 with keys 310 and connector 85, and thus is not required to be permanently coupled (e.g., welded) to WDP joint 34 in order to form pin end portion 60.

In an embodiment, axial movement of annular adapter 300 is prevented by the physical engagement between connector 85 and the protrusions 87 of pin 86. Further, adapter 300 is restricted from relative rotational movement with respect to WDP joint 34 by one or more anti-rotation keys 310 disposed within one or more slots 312 of WDP joint 34. However, with enough axial force applied to either coupler element 82 or adapter 300, pin 86 may be displaced from connector 85 without damaging or altering any of the components (adapter 300, connector 85, WDP joint 34, etc.). Thus, adapter 300 and coupler element 82 may be releasably coupled to WDP joint 34 via connector 85.

Figure 7:
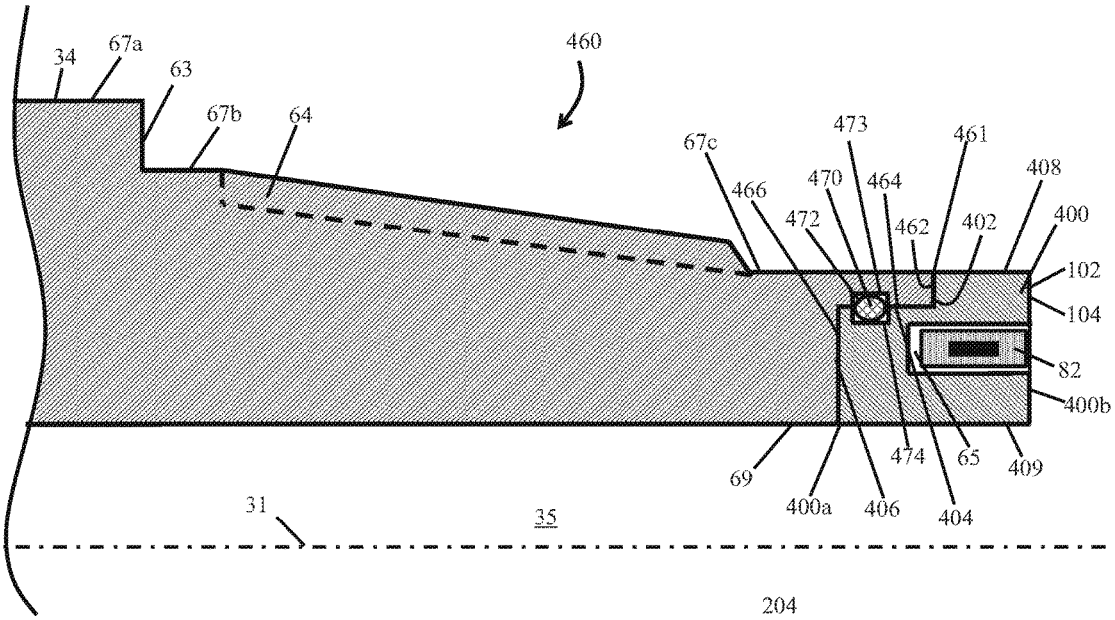
FIG. 7 is a cross-sectional view of another embodiment of a releasable shoulder of a RSTC as may be employed in the drilling system of FIG. 1.

Referring to FIG. 7, another embodiment of a removable strengthened shoulder of a RSTC is shown. In this embodiment, an adapter 400 is configured to be releasably coupled to a terminal end of a tubular member, such as WDP joint 34 via a latch 470. In an embodiment, latch 470 is configured to resist decoupling of adapter 400 from the WDP joint 34. A pin end portion 460 of WDP joint 34 comprises outer surfaces 67*a*, 67*b*, 67*c*, inner surface 69, threaded portion 64 and a mating cylindrical surface 464. In this embodiment, the radius of surface 464 is larger than the radius of inner surface 69 but smaller than the radius of outer surface 67*c*. An upper mating shoulder 462 is formed at a terminal end 461 of WDP joint 34 and radially extends inward from cylindrical surface 67*c* to surface 464. Cylindrical surface 464 extends axially into WDP joint 34 from terminal end 461. A lower mating shoulder 466 radially extends inward from cylindrical surfaces 464 to inner cylindrical surface 69.

Secondary annular shoulder 102 may be formed on pin end portion 260 of WDP joint 34 by coupling adapter 400 to WDP joint 34. In this embodiment, adapter 400 is configured to physically engage mating shoulders 462, 466 and cylindrical surface 464 of WDP joint 34. Adapter 400 has a central axis coaxial with axis 31 and comprises a first end 400*a*, a second end 400*b*, an outer cylindrical surface 408, an inner cylindrical surface 409 and a mating cylindrical surface 404. In this embodiment, the radius of surface 404 is larger than the radius of inner surface 409 but smaller than the radius of surface 408. A lower annular shoulder 406 is disposed at end 400*a* and extends radially outward from inner surface 409 to surface 404. Surface 404 extends axially from first end 400*a* toward second end 400*b*. An upper annular shoulder 402 extends radially outward from surface 404 to outer surface 408. In this embodiment, shoulder 406 of adapter 400 is configured to physically engage corresponding shoulder 466 of WDP joint 34. A slight gap exists between surfaces 464, 404, and 462, 402, respectively. Alternatively, in another embodiment shoulders 402 and 462 physically engage while a slight gap exists between surfaces 406, 466, and 404, 464, respectively. In another embodiment, shoulders 404 and 464 physically engage while a slight gap exists between shoulders 402, 462 and 406, 466, respectively. Adapter 400 may comprise the same materials as discussed with respect to annular adapters 100, 200, 300 (e.g., high nickel content and/or high copper content alloy steel) to provide for greater strength compared to the materials comprising WPD joint 34. In this embodiment, adapter 400 comprises a material having a harder Rockwell hardness rating than the material comprising WDP joint 34.

In this embodiment, pin end portion 460 and adapter 400 further comprise an annular latch 470 that is configured to releasably secure annular adapter 400 to WDP joint 34. Latch 470 has a central axis coaxial with axis 31 and is disposed within an annular cavity 472 that is defined by an upper recess 473 that extends radially into cylindrical surface 464 and a lower recess 474 that extends radially into cylindrical surface 404. Latch 470 is an annular member that extends entirely about axis 31. In an embodiment, latch 470 comprises rubber or other elastomeric, pliable or deformable material. In another embodiment, latch 470 comprises a spring. In this embodiment, latch 470 comprises a canted coiled spring connector, such as the Bal Latch connectors provided by Bal Seal Engineering, Inc., of 19650 Pauling, Foothill Ranch, Calif. 92610.

Latch 470 is biased to expand radially outward away from axis 31 and toward upper recess 473 of WDP joint 34. Because latch 470 is disposed within both upper recess 473 and lower recess 474, an axial force applied to annular adapter 400 in the direction away from WDP joint 34 will be resisted by physical engagement between latch 470 and recesses 473 and 474. However, a large enough axial force on adapter 400 may deform latch 470 such that latch 470 is displaced into either upper recess 473 or lower recess 474, which allows adapter 400 to be removed or disengaged from WDP joint 34 via an axial force applied to adapter 400. In this embodiment, latch 470 is useful for retaining adapter 400 on WDP joint 34 during transportation to a drilling system (e.g., drilling system 10) or storage thereat prior to being introduced into a borehole (e.g., borehole 11). Once pin end portion 460 of WDP joint 34 comprising latch 470 has been threadedly coupled to a corresponding box end portion of another WDP joint, the compressive stress placed on shoulder 102 due to the applied makeup torque will retain adapter 400 into place. Further, in this embodiment, anti-rotation keys, such as anti-rotation keys 310 discussed with reference to FIGS. 6A, 6B, may be used to restrict adapter 400 from rotating relative to WDP joint 34. A latch, such as latch 470, may also be used with adapter 300, so as to restrict axial movement of adapter 300 prior to coupling with another WDP joint. An electrical connection similar to the one described with respect to adapter 300 may also be implemented in a similar manner.

Figure 8:
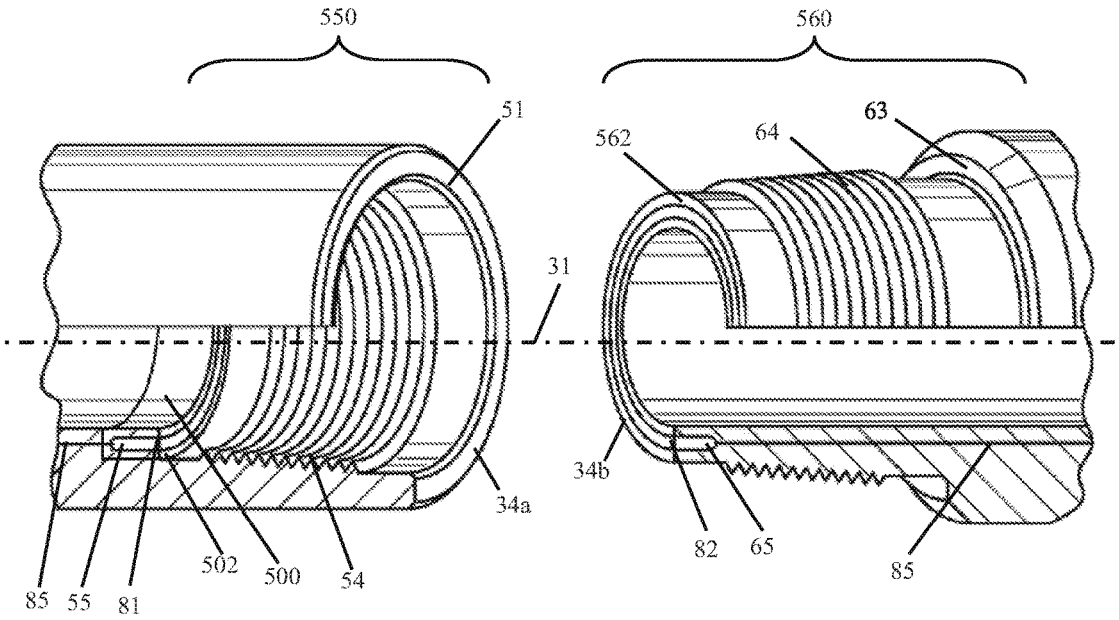
FIG. 8 is a perspective partial cross-sectional view of a pin end portion and a mating box end portion of a pair of tubulars used to form a drill string as may be employed in the drilling system of FIG. 1.
Figure 9:
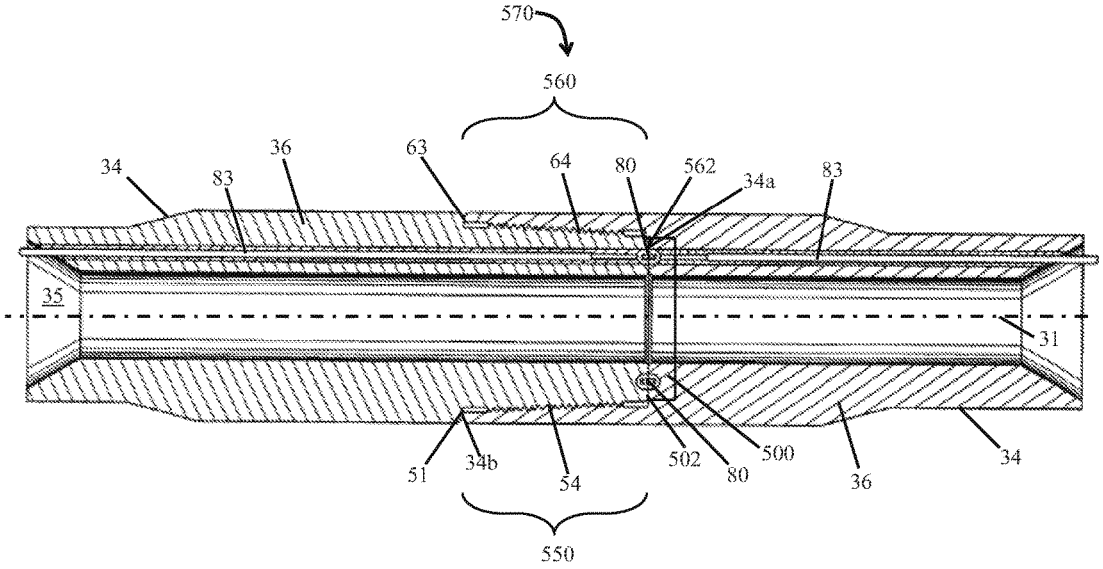
FIG. 9 is a cross-sectional view of a connection formed with the pin end portion and the box end portion of FIG. 8.

Referring now to FIGS. 8 and 9, an alternative embodiment of a strengthened annular shoulder is shown. In this embodiment, the tubulars forming drill string 30 (e.g., WDP joints 34, etc.) include a box end portion 550 and a mating pin end portion 560, it being understood that all the pin end portions, box end portions, tubular body 36 and connections in drill string 30 are configured similarly in this example. Pin end portion 560 comprises an axial portion of WDP joint 34 extending between primary or radially outer shoulder 63 and a secondary or radially inner shoulder 562 disposed at terminal end 34*b* of WDP joint 34. Pin end portion 560 generally includes primary shoulder 63, secondary shoulder 562 axially displaced from shoulder 63, and threads 64. Box end portion 550 comprises an axial portion of WDP joint 34 extending between a secondary or radially inner shoulder 502 and primary or radially outer shoulder 51 disposed at terminal end 34*a* of WDP joint 34. Box end portion 550 includes primary outer shoulder 51 and a strengthened annular adapter 500 that forms a secondary or inner annular shoulder 502. Since box end portion 550 and pin end portion 560 each include two planar shoulders 51, 502 and 63, 562, respectively, ends 550, 560 form a double shouldered RSTC upon being threaded together via mating threads 54, 64 to form connection 570. When threading box end portion 550 into a pin end portion 560, outer shoulders 51, 63 may axially abut and engage one another, and inner shoulders 502, 562 may axially abut and engage one another to provide structural support and to distribute stress across the connection. First inductive coupler element 81 is seated in an annular recess 55 formed in inner shoulder 502 of annular adapter 500, and second inductive coupler element 81 is seated in an annular recess 65 formed in inner shoulder 562 of pin end portion 560. As shown in FIG. 9, upon forming a connection 570, box end portion 550 and pin end portion 560 axially overlap. as primary shoulders 51, 63 abut and secondary shoulders 502, 562 abut.

Figure 10:
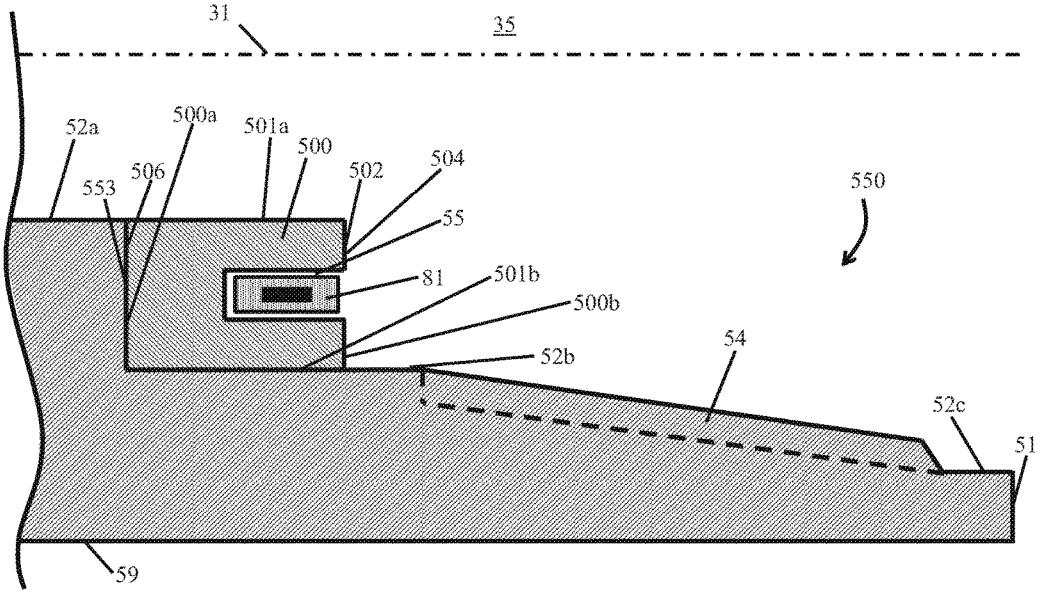
FIG. 10 is a cross-sectional view of an embodiment of a strengthened shoulder of a RSTC as may be employed in the drilling system of FIG. 1.

Referring now to FIG. 10, an embodiment of a strengthened shoulder of a box end portion of a RSTC is shown. In this embodiment, annular adapter 500 is configured to be coupled to a box end portion of a tubular member, such as WDP joint 34. Box end portion 550 of a WDP joint 34 comprises a first inner cylindrical surface 52*a*, a second inner cylindrical surface 52*b*, a third cylindrical inner surface 52*c*, an outer cylindrical surface 59, an inner or primary annular shoulder 553 extending radially from surface 52*a* to surface 52*b*, a frustoconical threaded segment or portion 54 and outer radial shoulder 51 that extends radially from cylindrical surface 52*c* to outer surface 59. In this embodiment, inner annular shoulder 502 is formed on the box end portion 550 of a WDP joint by coupling adapter 500 to shoulder 553 of box end portion 550. Annular adapter 500 has a central axis coaxial with axis 31, a first end 500*a* and a second end 500*b*. Annular secondary shoulder 502 of adapter 500 extends radially from an inner cylindrical surface 501*a* to an outer cylindrical surface 501*b*, and includes annular groove or recess 55 that extends axially into adapter 500 from terminal end 500*b*. In this embodiment, inner surface 501*a* has a radius substantially equal to the radius of surface 52*a* and outer surface 501*b* has a radius substantially equal to the radius of surface 52*b*. In the embodiment of FIG. 9, coupler element 81 is disposed within recess 55 of adapter 500 to allow for the passing of electronic signals across the WDP joint 34 upon being made up with the pin end portion 560 of an adjacent WDP joint.

Annular secondary shoulder 502 defines an annular face 504 having a surface area. During makeup procedures, as box end portion 560 and pin end portion 550 of two adjacent WDP joints 34 are made up to form joint 570, a compressive force is applied to the face 504 of adapter 500 by a corresponding shoulder (e.g., shoulder 562 shown in FIG. 8) on the pin end portion of the other WDP joint. In the embodiment of FIG. 9, adapter 500 comprises a material configured to have high strength (e.g., compressive strength) and weldability characteristics with materials such as carbon steels, steel alloys, or other materials that may form drill pipe or other tubulars. In this embodiment, the hardness of the material comprising adapter 500 has a harder Rockwell hardness than the material comprising WDP joint 34. Adapter 500 comprises a steel alloy having a high nickel, chrome, cobalt, and/or copper content, such as Monel, Hastelloy, Inconel, Waspaloy, Rene alloys, and the like. An alloy containing a high nickel content may be chosen to augment the strength of the adapter 500. An alloy containing a high copper content may be chosen to augment the electrical conductivity of adapter 500. In another embodiment, adapter 500 may comprise a high nickel content steel alloy coated in a higher copper content material in order to provide for both high strength and electrical conductivity of adapter 500.

Referring still to FIG. 10, first end 500*a* of adapter 500 is configured to couple to WDP joint 34 at shoulder 553 of the joint 34. Adapter 500 is coupled at first end 500*a* to shoulder 553 of WDP joint 34 using a means configured to allow the adapter 500 to resist torsional, compressive and other loads applied to adapter 500. For instance, adapter 500 is welded at first end 500*a* to shoulder 553 of WDP joint 34 using an electron beam welding procedure where the kinetic energy of a beam of electrons is used to fuse the adapter 500 and WDP joint 34 together at end 500*a* and shoulder 553. In another embodiment, adapter 500 may be friction welded to WDP joint 34 at end 500*a* and shoulder 553, respectively. For instance, in this procedure annular adapter 500 is rotated about axis 31 as first end 500*a* of adapter 500 abuts and physically engages shoulder 553 of WDP joint 34, causing adapter 500 and WDP joint 34 to fuse together at end 500*a* and shoulder 553 due to the friction generated by the sliding engagement between adapter 500 and WDP joint 34. In still further embodiments, adapter 500 may be coupled to box end portion of a WDP joint using a TIG welding procedure, or adapter 500 may be releasably coupled to WDP joint 34 using a removable connector, as described with respect to the embodiment shown in FIGS. 6A-6C.

The embodiments described herein may be used to strengthen a RSTC connection with respect to the stresses placed on the RSTC connection during makeup. Such embodiments offer the potential for improved durability of the RSTC connections with respect to conventional wired drilling pipes that are employed without strengthened adapters. Further, the embodiments described herein offer the potential of increasing the amount of makeup torque that can be applied during the coupling of WDP joints or tubulars. For example, a WDP comprising an adapter formed from relatively higher strength material may withstand higher compressive loads resulting from makeup, than a WDP featuring an adapter formed from standard drill pipe material. Moreover, because only the adapter (e.g., adapter 100, 200, 300, 400 and 500) comprises the relatively stronger materials (e.g., high nickel and/or copper steel alloys), the benefits of ductility and fatigue resistance offered by traditional drilling pipe materials (e.g., carbon steel) may still be relied upon as a substantial amount of material comprising the WDP would remain as traditional drilling pipe materials.

While embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. An adapter for a wired drill pipe joint, comprising:

an annular adapter body having a first end, a second end, and an outer recess;

an annular recess extending partially into the first end of the adapter body;

a communication element disposed at least partially within the annular recess;

wherein the second end of the adapter body is configured to be coupled to an end portion of a first wired drill pipe joint; and an annular latch coupled to the adapter body and configured to contact the first wired drill pipe joint when the adapter body is coupled to the first wired drill pipe joint and to resist decoupling of the adapter body from the first wired drill pipe joint;

wherein the latch is received in the outer recess of the adapter body when the adapter body is coupled to the first wired drill pipe joint;

wherein the annular adapter body and the communication element form a shoulder configured for engagement with a corresponding shoulder of a second wired drill pipe joint to form a rotary shouldered threaded connection between the first wired drill pipe joint and the second wired drill pipe joint.

2. The adapter of claim 1, wherein the latch comprises a canted coil spring.

3. The adapter of claim 1, wherein the latch is biased to expand radially outward with respect to a central axis of the latch.

4. The adapter of claim 1, wherein the second end of the adapter body is configured to be releasably coupled to an end portion of the first wired drill pipe joint.

5. The adapter of claim 1, wherein the adapter body further comprises an arcuate key that is configured to restrict relative rotation of the adapter body with respect to the first wired drill pipe joint.

6. The adapter of claim 5, wherein the first wired drill pipe joint further comprises a slot, and wherein the arcuate key of the adapter body is configured to be inserted at least partially into the slot.

7. The adapter of claim 1, wherein the latch is disposed radially between the annular adapter body and the first wired drill pipe joint when the adapter body is coupled to the first wired drill pipe joint.

8. The adapter body of claim 7, wherein, when the adapter body is coupled to the first wired drill pipe joint, the annular latch is biased radially outwards into an inner recess of the first wired drill pipe joint to secure the adapter body to the first wired drill pipe joint.

9. A method for forming a wired drill pipe joint, comprising:

coupling an annular adapter body to an end portion of a first wired drill pipe joint;

disposing a communication element within an annular recess of the adapter body; and disposing a latch in a recess positioned between the adapter body and the first wired drill pipe joint;

wherein coupling the adapter body to an end portion of the first wired drill pipe joint forms an annular shoulder on an end portion of the first wired drill pipe joint that is configured to engage a corresponding annular shoulder of a second wired drill pipe joint for forming a rotary shouldered threaded connection between the first wired drill pipe joint and the second wired drill pipe joint.

10. The method of claim 9, wherein coupling the adapter body to an end portion of the first wired drill pipe joint comprises releasably coupling the adapter body to an end portion of the first wired drill pipe joint.

11. The method of claim 9, further comprising inserting an arcuate key of the adapter body into a slot of the first wired drill pipe joint.

12. The method of claim 9, further comprising decoupling the adapter body from the end portion of the first wired drill pipe joint.

13. The method of claim 9, further comprising:

forming a joint between the first wired drill pipe joint and a second wired drill pipe joint; and providing a compressive stress against a side of the adapter body.

14. The method of claim 13, further comprising communicating a signal between the first wired drill pipe joint and the second wired drill pipe joint.

15. The method of claim 9, further comprising biasing the latch radially outwards into a recess of the first wired drill pipe joint to secure the adapter body to the first wired drill pipe joint.

16. A wired drill pipe joint, comprising:

an annular adapter body having a first end and a second end;

an annular recess extending partially into the first end of the adapter body;

a communication element disposed at least partially within the annular recess;

wherein the second end of the adapter body is configured to be releasably coupled to an end portion of a first wired drill pipe joint;

a pin coupled to the communication element; and a connector disposed within a recess of the first wired drill pipe joint and configured to releasably engage the pin;

wherein the annular adapter body and the communication element form a shoulder of the first wired drill pipe joint configured for engagement with a corresponding shoulder of a second wired drill pipe joint to form a rotary shouldered threaded connection between the first wired drill pipe joint and the second wired drill pipe joint.

17. The wired drill pipe joint of claim 16, wherein the annular adapter body comprises an arcuate key configured to restrict relative rotation of the adapter body with respect to the first wired drill pipe joint.

18. The wired drill pipe joint of claim 17, wherein the first wired drill pipe joint further comprises an arcuate slot, and wherein the arcuate key is disposed at least partially in the arcuate slot.

19. The wired drill pipe joint of claim 16, wherein the pin comprises an electrical conductor configured to communicate an electrical signal to the connector.

20. The wired drill pipe joint of claim 16, wherein:

the pin comprises protrusions extending radially from the pin; and the connector comprises a socket configured to receive the protrusions of the pin to couple the adapter body to the first wired drill pipe joint.

* * * * *